US005910167A

United States Patent [19]

Reinke et al.

[11] Patent Number: 5,910,167

[45] Date of Patent: Jun. 8, 1999

[54] INLET FOR AN EVAPORATOR

[75] Inventors: Michael J. Reinke, Franklin; Mark Voss, Franksville, both of Wis.

[73] Assignee: Modine Manufacturing Co., Racine, Wis.

[21] Appl. No.: 08/954,646

[22] Filed: Oct. 20, 1997

[51] Int. Cl.[6] ..... F25B 39/02

[52] U.S. Cl. ..... 62/525; 165/174

[58] Field of Search ..... 62/525, 527; 165/174; 285/192, 193

[56] References Cited

U.S. PATENT DOCUMENTS

| | | | |
|---|---|---|---|
| 1,684,083 | 9/1928 | Bloom | 62/525 |
| 3,976,128 | 8/1976 | Patel et al. | 62/525 |
| 5,048,602 | 9/1991 | Motohashi et al. | 285/192 |
| 5,534,202 | 7/1996 | Roberts et al. | 285/192 |

*Primary Examiner*—William E. Tapolcal
*Attorney, Agent, or Firm*—Wood, Phillips, VanSanten, Clark & Mortimer

[57] ABSTRACT

Distribution of liquid refrigerant in an evaporator having a pair of spaced headers (20), (22) and a plurality of tubes (24) extending between the headers (20), (22) to define a plurality of spaced refrigerant passages (42) is achieved through the use of at least one refrigerant inlet (30), (32), (34), (36) within one of the headers (20). The inlet has a first port (49) adapted to be connected to a source of refrigerant to be evaporated, and oppositely directed second and third ports (50), (52) connected to the first port (49). The second port (50) is directed away from one side (44) of the header (20) while the third port (54) is directed toward the side (44) of the header (20).

13 Claims, 3 Drawing Sheets

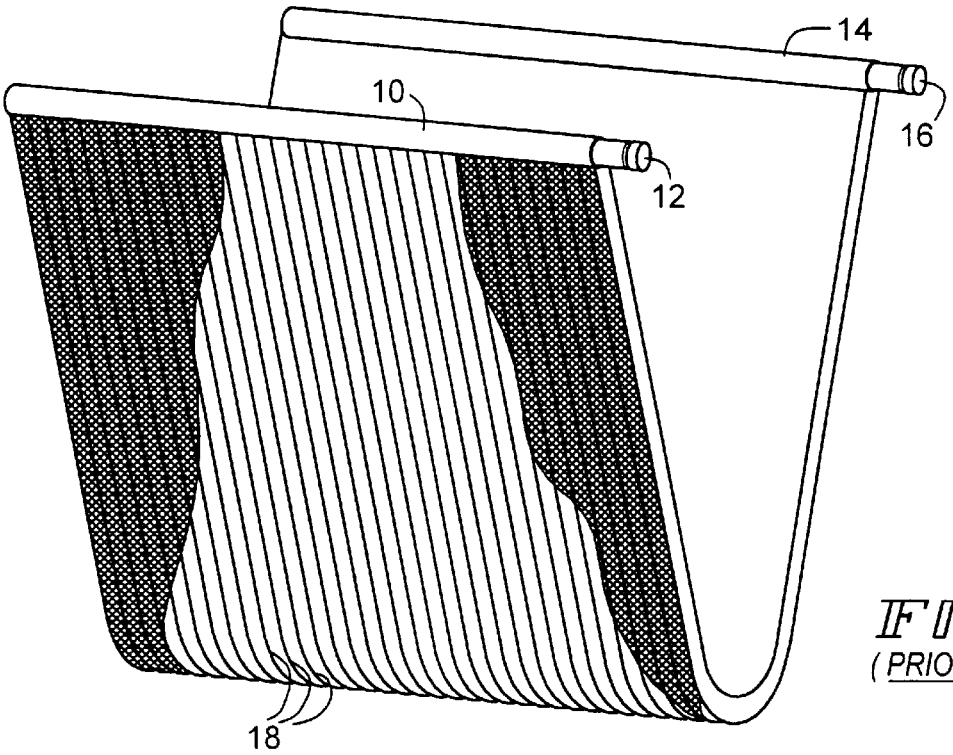
FIG. 1
(PRIOR ART)
FIG. 2
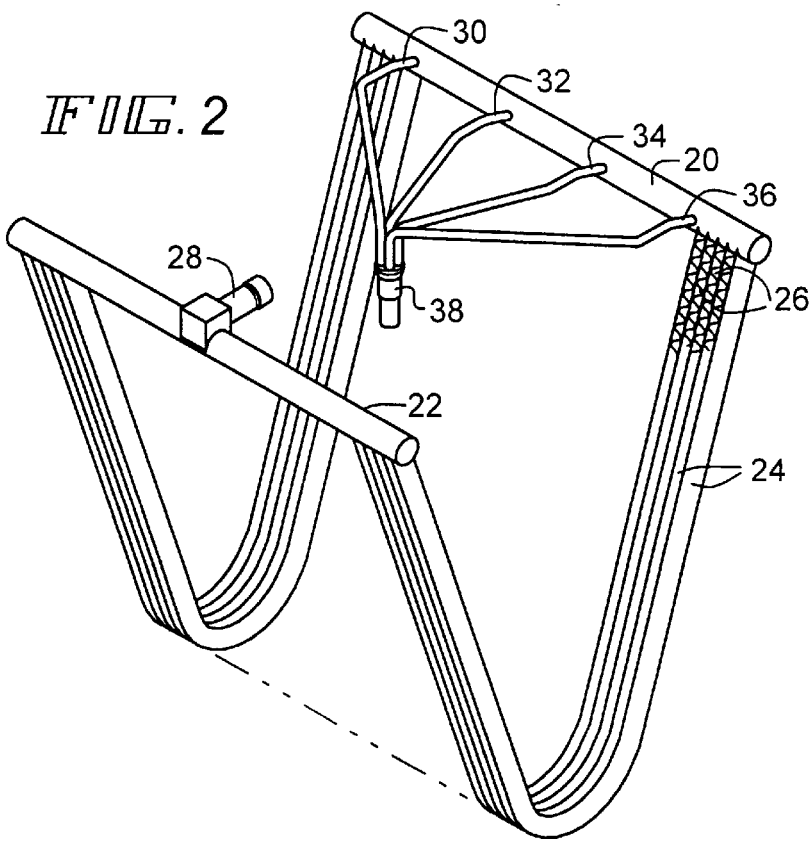

INLET FOR AN EVAPORATOR

FIELD OF THE INVENTION

This invention relates to evaporators for refrigerants, and more particularly, to an improved inlet for such an evaporator to improve the efficiency of the evaporation operation.

BACKGROUND OF THE INVENTION

Commonly owned U.S. Pat. Nos. 5,341,870 issued Aug. 30, 1994 and 5,533,259 issued Jul. 9, 1996, both to Hughes et al, the complete disclosures of both of which are herein incorporated by reference, disclose unique evaporators for refrigerants that are ideally suited for use in residential air-conditioning applications. While the structures disclosed in the Hughes et al patents work well for their intended purpose, and indeed are a considerable improvement over conventional evaporators employed in air-conditioning systems, they are subject to the same difficulties in terms of efficiency if the refrigerant is not properly distributed within the evaporator.

When poor distribution occurs, one section of the evaporator core is often flooded with liquid refrigerant while another section is essentially starved of refrigerant. An example of poor distribution, based on the infrared thermal image of an actual evaporator, is shown in FIG. 1. This distributor is of the general configuration illustrated in the above identified Hughes et al patents and is of the type wherein one header 10 may be provided with an inlet fixture 12 and the opposite header 14 provided with an outlet fixture 16. That is to say, the evaporator illustrated is what is known in the trade as an end feed, end draw, "V" evaporator of the parallel flow variety.

The tubes interconnecting to headers 10 and 14 are schematically illustrated at 18 and of course, serpentine fins (not shown) extend between adjacent ones of the tubes 18.

In such an evaporator, tubes which are starved of refrigerant quickly run out of liquid or mixed refrigerant. Consequently, sizable percentages of the length of each starved tube contain only single phase, superheated gaseous refrigerant. Heat transfer is poor.

Furthermore, air side surface temperatures where there is superheated gas flow are typically above the dew point and consequently, there will be no condensation of moisture from air flowing through the evaporator in those areas of superheated flow. Thus, no dehumidification takes place in those areas.

Where dehumidification does take place, moisture will be present on the exterior of the tubes and will increase the resistance to airflow through the evaporator at those locations. That is to say, airflow resistance will be less in those areas of superheated flow and consequently, the superheated areas receive a disproportionate amount of the total airflow through the evaporator, further reducing efficiency.

Flooded tubes produce excellent heat transfer throughout but often fail to evaporate all of the liquid refrigerant. Consequently, the unevaporated refrigerant is not put to use and the work employed in condensing the vapor to a liquid is essentially wasted. Furthermore, the presence of unevaporated liquid in the suction line may cause thermal expansion valves used in the system to "hunt." Unstable operation will result.

As seen in FIG. 1, areas wherein superheated gas flow occurs are shaded. In contrast, the nonshaded areas indicate proper functioning areas or areas where the tubes are flooded.

The present invention is directed to achieving a more uniform distribution of refrigerant in evaporators generally and in "V" evaporators of the parallel flow variety by eliminating or minimizing areas in the evaporator core that may be starved of refrigerant and result in excessive superheating of refrigerant.

SUMMARY OF THE INVENTION

It is the principal object of the invention to provide a new and improved evaporator for a refrigerant. More specifically, it is an object of the invention to provide a new and improved inlet structure for an evaporator for a refrigerant to achieve more uniform distribution of refrigerant within the evaporator.

An exemplary embodiment of the invention achieves the foregoing object in an evaporator including a pair of spaced headers. At least one tube extends between the headers and is in fluid communication with each at one side thereof and defines a plurality of spaced refrigerant passages extending between the headers. At least one refrigerant inlet is located on one of the headers. The inlet has a first port connected to a source of refrigerant to be evaporated and a second port connected to the first port and located within the one header and directed away from the one side of the one header. As a result, refrigerant to be evaporated is sprayed on the interior of the header oppositely of the location of the refrigerant passages and the header itself serves as an impingement distributor.

In a preferred embodiment, the inlet includes a third port which is also connected to the first port. The third port is directed oppositely of the second port and toward the side of the header containing the passages. The third port thus provides impingement distribution of refrigerant for tubes closely adjacent the inlet while the second port provides impingement distribution for passages more remote from the inlet.

In a preferred embodiment, the third port is smaller than the second port.

Preferably, the plurality of passages is defined by a plurality of the tubes and the tubes in the plurality are spaced from one another.

In a preferred embodiment, the plurality of tubes have respective tube ends entering the one side of each of the headers.

Preferably, each tube additionally defines a plurality of spaced refrigerant passages.

In a highly preferred embodiment, the one header is elongated and there are a plurality of the refrigerant inlets spaced along the length of the one header.

Also in a preferred embodiment, at least the one header is generally tubular.

A preferred embodiment contemplates an evaporator that includes an elongated header. A plurality of spaced, flattened tubes are provided and have ends received in one side of the header in equally spaced relation. An inlet to the header is provided and includes a plurality of spaced injectors, each adapted to be connected to a common source of refrigerant to be evaporated. Each injector includes a discharge orifice directed away from the one side of the header which receives the ends of the flattened tubes.

In a preferred embodiment, the ends of the tubes extend into the interior of the header and the injectors are located between the ends of pairs of adjacent tubes.

Preferably the discharge orifices are primary discharge orifices and each injector further includes a secondary discharge orifice that is smaller than the primary discharge orifice and which is directed toward the one side of the header between the ends of pairs of adjacent tubes.

Other objects and advantages will become apparent from the following specification taken in connection with the accompanying drawings.

DESCRIPTION OF THE DRAWINGS

FIG. 1 is a perspective view of an evaporator made according to the prior art;

FIG. 2 is a perspective view of an evaporator made according to the invention;

DESCRIPTION OF THE PREFERRED EMBODIMENT

Figure 3:
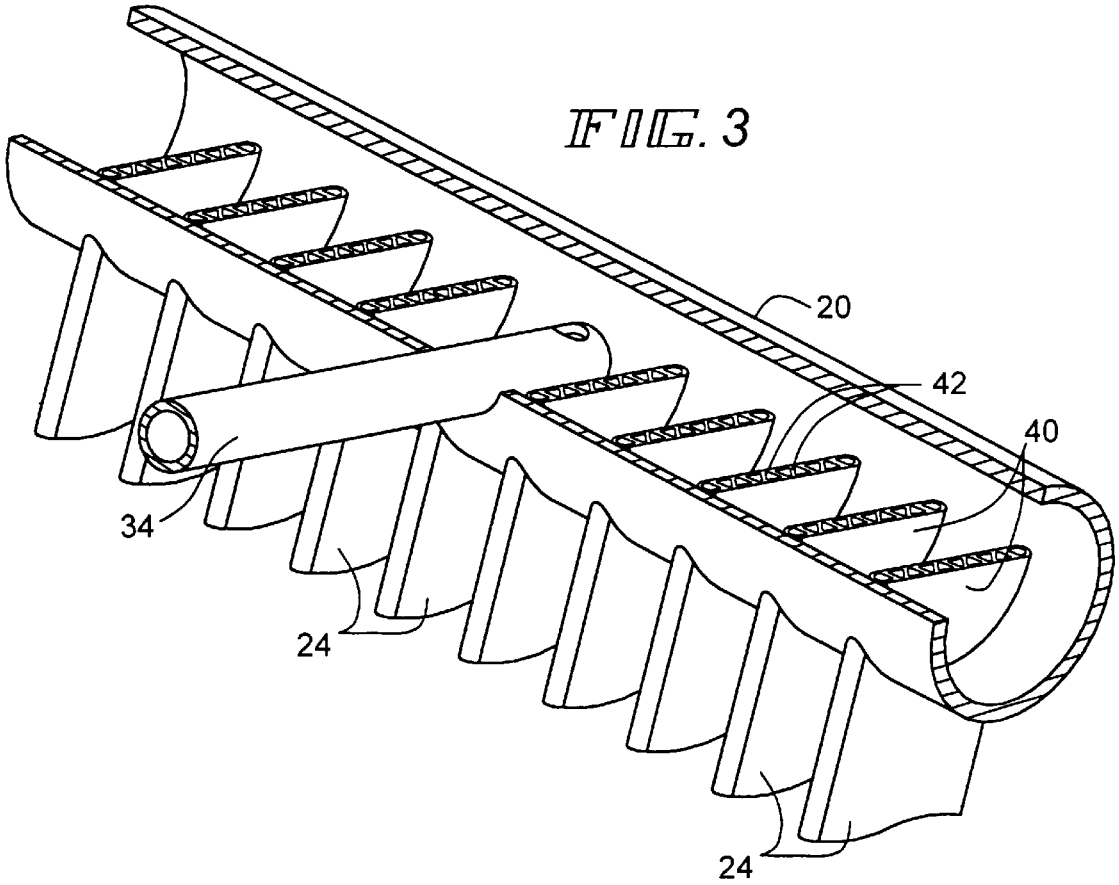
FIG. 3 is an enlarged, fragmentary view of an inlet injector used in the evaporator.

An exemplary embodiment of the invention is illustrated in FIGS. 2–5, inclusive and will be described herein in the context of a so called "V" evaporator of the parallel flow type. However, it should be understood that the invention is not limited to such evaporators. It may be used with efficacy in any evaporator having a header that is in fluid communication with a plurality of spaced refrigerant passages.

The evaporator includes an inlet header 20 in the form of an elongated tube. Also included is an outlet header 22. A series of flattened, multi-port tubes 24 interconnect headers 20 and 22. Serpentine fins 26 are disposed between adjacent ones of the flattened tubes 24.

The outlet header 22 includes a single outlet fixture 28 which may be of conventional construction. The inlet header 20, at equally spaced locations along its length, in a preferred embodiment, receives four refrigerant injectors 30, 32, 34 and 36. The injectors 30, 32, 34 and 36 may be common tubes that all are connected to a conventional distributor 38 which in turn may be connected to a common source of liquid refrigerant, i.e., ultimately the condenser of a refrigeration system, whether used for pure refrigeration purposes, heat pumps or air-conditioning purposes or all three.

Referring to FIG. 3, each of the tubes 24 have an end 40 that extends a substantial distance into the interior of the inlet header 20. The tube ends 40 reveal that each tube itself includes a plurality of separate passages 42 which preferably are of a hydraulic diameter of 0.07" or less. Hydraulic diameter is as conventionally defined, namely, four times the cross sectional area of each passage 42 divided by the wetted perimeter of the passage.

The ends 40 are spaced and as can be seen in FIG. 3, a representative of one of the injectors, namely the injector 34, is located between the ends of a pair of adjacent tubes 24. As can also be appreciated, the injector 34 and the injectors 30, 32 and 36, are formed of a round tube of smaller diameter than the tube forming the inlet header 20. The injector 34 enters the header 20 at nominally right angles thereto as well as to the plane defined by the tubes 24 near the header 20.

Figure 4:
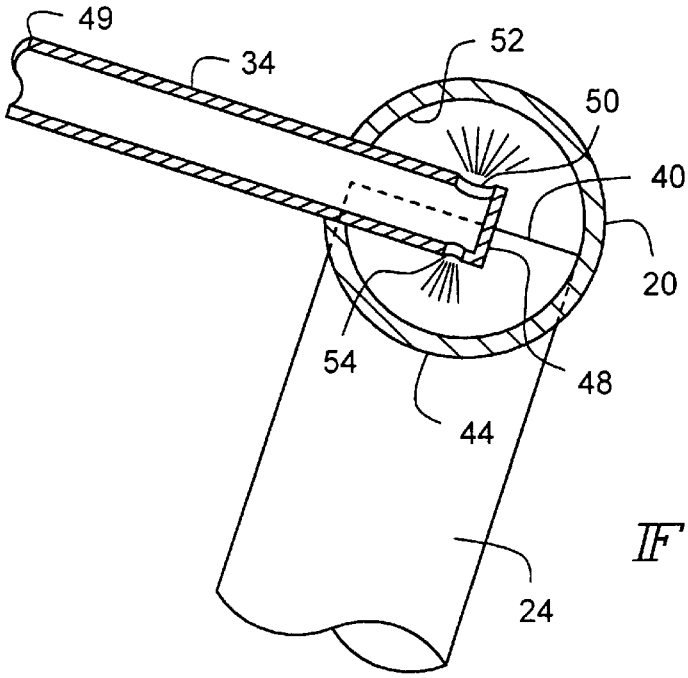
FIG. 4 is an enlarged, fragmentary sectional view of the inlet injector.

As seen in FIG. 4, the tubes 24 enter a side 44 of the header 20 with the ends 40 extending almost halfway through the interior of the header 20. The injector 34 includes a sealed end 48 within the header 20. Oppositely thereof is a port 49 to be connected to receive refrigerant. The injector 34 also includes a first or primary discharge orifice 50 which discharges against the interior side 52 of the header 20 that is opposite from the side 44 whereat the tubes 24 enter the header 20. A secondary discharge orifice 54 is also located in the injector 34 within the header 20 on a common center line with the primary discharge orifice 50. The secondary discharge orifice 54 is of smaller size than the primary discharge orifice and directs liquid refrigerant toward the side 44. The point of injection may be at a location between adjacent ones of the tube ends 40 or at location aligned with a tube end.

The spray of liquid emerging from the primary discharge orifice spreads along the interior side 52 of the header 20 to distribute the refrigerant along a substantial distance within the header so that the entirety of the tubes 24 between the locations of the injectors 30, 32, 34 and 36 receive refrigerant. In many cases, only the primary discharge orifices 50 are required. However, sometimes, particularly where the tubes ends 40 extend a substantial distance into the interior of the header 20, those tubes in immediate proximity to the injectors 30, 32, 34 or 36 may not receive sufficient refrigerant because it is literally blown past their ends 40 as a result of the impingement on the inner surface 52. Thus, the secondary discharge orifices 54 may be provided in each injector 30, 32, 34 and 36 to assure that the tubes 24 closely adjacent each injector location receive an adequate supply of liquid refrigerant.

Figure 5:
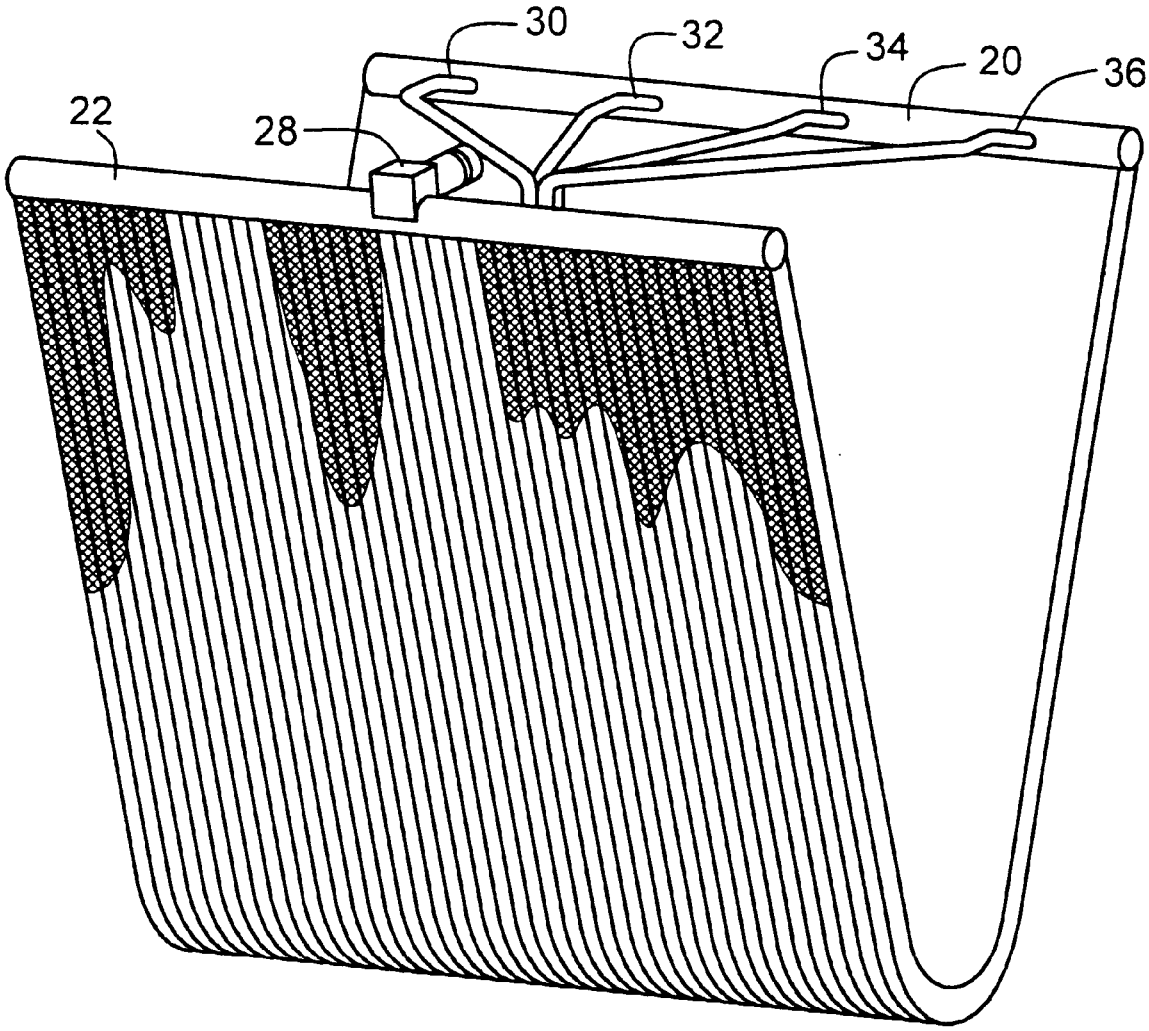
FIG. 5 is a view similar to FIG. 1 but illustrating an evaporator made according to the invention.

FIG. 5 represents the infrared thermal image of an actual evaporator made according to the invention. The shaded areas thereon represent areas where superheated vapor flow is occurring. It will be seen that the use of the invention in the evaporator FIG. 5 substantially reduces such areas to considerably improve the efficiency of operation of the evaporator over that depicted in FIG. 1.

In an evaporator such as that illustrated which is designed as a 30,000 BTU/hour evaporator, there are four injector points. Each injector is made of a tube having a 0.25" outside diameter and a 0.035" wall thickness. The primary discharge orifices 50 have a diameter of 0.125" while the secondary discharge orifices 54 have a diameter of 0.052". In one embodiment, the evaporator has 45 of the flattened tubes 24 in its core, meaning 11.25 tubes 24 per injector.

From the foregoing, it will be readily appreciated that an evaporator made according to the invention achieves excellent distribution of incoming liquid refrigerant to improve the efficiency of operation. The structure employed is relatively simple in that the injectors may be made from tubing with the discharge orifices bored in them to the proper size. Consequently, a real improvement in efficiency can be obtained at minimal cost or complexity.

We claim:

1. An evaporator comprising a pair of spaced headers;

at least one tube extending between said headers and in fluid communication with each at one side thereof and defining a plurality of spaced refrigerant passages extending between said headers; and at least one refrigerant inlet within one of said headers, said inlet having a first port adapted to be connected to a source of refrigerant to be evaporated and oppositely directed second and third ports connected to said first port, said second port being directed away from said one side and said third port being directed toward said one side.

2. The evaporator of claim 1 wherein said third port is smaller than said second port.

3. The evaporator of claim 1 wherein said plurality of passages are defined by a plurality of said tubes, the tubes in said plurality being spaced from one another.

4. The evaporator of claim 3 wherein said plurality of tubes have respective tube ends entering said one side of each of said headers.

5. The evaporator of claim 3 wherein each of said tubes additionally defines a plurality of spaced refrigerant passages.

6. The evaporator of claim 1 wherein said one header is elongated and there are a plurality of said refrigerant inlets spaced along the length of said one header.

7. The evaporator of claim 1 wherein at least said one header is generally tubular.

8. An evaporator comprising a pair of spaced headers;

at least one tube extending between said headers and in fluid communication with each at one side thereof and defining a plurality of spaced refrigerant passages extending between said headers; and at least one refrigerant inlet within one of said headers, said inlet having a first port adapted to be connected to a source of refrigerant to be evaporated and a second port connected to said first port and located within said one header and being directed away from said one side of said one header.

9. The evaporator of claim 8 wherein said inlet includes a third port within said header and connected to said first port, said third port being directed toward said one side of said one header.

10. The evaporator of claim 9 wherein said plurality of passages is defined by a plurality of spaced tubes and said second and third ports are located between two adjacent tubes.

11. An evaporator comprising:

an elongated header;

a plurality of spaced, flattened tubes and having ends received in one side of said header in substantially equally spaced relation; and an inlet to said header including a plurality of spaced injectors each adapted to be connected to a common source of refrigerant to be evaporated, each injector including a discharge orifice directed away from said one side of said header.

12. The evaporator of claim 11 wherein said ends extend into the interior of said header and said injectors are located between the ends of pairs of adjacent tubes.

13. The evaporator of claim 11 wherein said discharge orifices are primary discharge orifices, each said injector further including a secondary discharge orifice smaller than said primary discharge orifice and directed toward said one side between said ends of pairs of adjacent tubes.

* * * * *